455-67 3R
6/15/82 XR 4,335,375

United States Patent [19]
Schaeffer
[11] 4,335,375
[45] Jun. 15, 1982

[54] CONTAINER FOR AN ALARM TRANSMITTER ADAPTED FOR INSERTION INTO A WALL

[76] Inventor: Daniel D. Schaeffer, 757 Ocean Ave., Santa Monica, Calif. 90402

[21] Appl. No.: 877,377

[22] Filed: Feb. 13, 1978

[51] Int. Cl.³ ..... G08B 1/08; G08B 13/08

[52] U.S. Cl. ..... 340/539; 340/545; 340/547; 138/96 R; 206/328; 220/284; 455/67; 455/128

[58] Field of Search ..... 340/539, 164 R, 545, 340/546, 547, 541; 325/111, 119, 127; 116/72, DIG. 38, 85, 86, 75; 70/158, 163, 164, 447, 449, DIG. 34; 138/89, 96 R; 206/328, 329; 220/284, 286; 455/66, 67, 89, 90, 91, 95, 101, 115, 128

[56] References Cited

U.S. PATENT DOCUMENTS

| | | | |
|---|---|---|---|
| 2,995,751 | 8/1961 | Bosch | 325/364 |
| 3,068,415 | 12/1962 | Johnson | 325/104 |
| 3,108,223 | 10/1963 | Hunter | 325/111 |
| 3,299,356 | 1/1967 | Bornhorst et al. | 325/111 |
| 3,415,086 | 12/1968 | Trainor | 70/161 |
| 3,641,540 | 2/1972 | Cutler et al. | 340/539 |
| 3,718,862 | 2/1973 | Norris | 325/111 |
| 3,725,887 | 4/1973 | Sneider | 340/539 |
| 3,912,116 | 10/1975 | Chahley | 220/284 |

*Primary Examiner*—John W. Caldwell, Sr.
*Assistant Examiner*—Donnie Lee Crosland
*Attorney, Agent, or Firm*—W. Edward Johansen

[57] ABSTRACT

A container for an alarm transmitter used in combination with components of a transmitter circuitry which includes voltage control for providing a gated voltage and controlled by a timing circuit. The components also include an audio multivibrator which is electrically coupled to the voltage control in order to receive the gated voltage, a microfork audio filter which is electrically coupled to the audio multivibrator and a modulator which is electrically coupled to the audio multivibrator. The components further include a radio frequency oscillator whose frequency is modulated by the modulator and which has an antenna electrically coupled to its output terminal. The container includes a tubular member which is adapted to be installed into a hole in a wall adjacent to a door or a window and an elongated, rectangular member adapted to be inserted into the tubular member and also adapted to have the components of the transmitter circuitry placed thereon. The container also includes a battery, which has one of its lead electrically coupled to the voltage control and electrical-coupling device for electrically coupling the other lead of the battery to the voltage control in order to complete the circuit. The electrical-coupling device includes a reed relay which is held normally open by a magnet which is placed in the adjacent door or window.

7 Claims, 1 Drawing Figure

CONTAINER FOR AN ALARM TRANSMITTER ADAPTED FOR INSERTION INTO A WALL

BACKGROUND OF THE INVENTION

1. Field of the Invention

The present invention relates to transmitters for wireless alarm systems that incorporate batteries, and more particularly to transmitters which can be easily and swiftly inserted into walls adjacent to doors and windows within a commercial or residential structure.

2. Description of the Prior Art

U.S. Pat. No. 4,056,815, entitled Battery Operated Transmitter Circuit, issued to Arthur Ernest Anderson on Nov. 1, 1977, teaches a battery operated code producing wireless RF alarm detection circuit which is designed to continuously monitor the condition of the battery and to periodically determine the operational integrity of the detection circuit as well as communicate distinct codes indicative of operation integrity of the detection circuit and alarm conditions. A local receiver responds to the RF transmitted codes from one or more alarm detection circuits.

According to the above cited patent the existence of a market for wireless alarm systems has produced numerous design concepts, with and without batteries. The design concepts based on the use of batteries have suffered due to the limited life of available batteries which adversely affects the reliability of the alarm systems. The mechanical alarm systems designed to operate without the use of batteries, typically storing energy by mechanical means which are triggered by disturbance of a monitored object, i.e. a door or window, have suffered from such disadvantages as "one shot" operation thereby lacking the capability to repeatedly transmit alarm conditions. While both the battery and non-battery alarm systems exhibit operation limitations, the non-battery systems are generally preferred inasmuch as a battery system is considered to have a higher probability of failure.

U.S. Pat. No. 3,988,724, entitled Theft Alarm, issued to David John Anderson on Oct. 26, 1976, teaches a transmitter for transmitting an alarm signal. There is also a magnetically activated normally-closed switch which is mechanically connected between the battery within the transmitter housing a position responsive switch device.

U.S. Pat. No. 4,019,139, entitled Interaction Multistation Alarm System, issued to Jose I. Ortega on Apr. 19, 1977, teaches a combination apparatus for transmitting and receiving alarm indications which is used in plurality to constitute a vigilance alarm network. The transmitter which is energizable for selectively generating a preselected tone modulated output transmission signal of a selected frequency.

U.S. Pat. No. 3,969,709, entitled Wireless Burglar Alarm System, issued to Roger Isaacs and Albert Stern on July 13, 1976, teaches a radio intrusion alarm system utilizing a high frequency carrier signal having an audio subcarrier which may be modulated by two tone signals, the first tone signal causing actuation of an alarm and the second tone signal causing actuation of a time delay device which inhibits operation of the alarm to permit an authorized entry at the transmitter location without giving the alarm.

According to the above cited patent prior art burglar alarm systems are tedious, expensive and difficult to install. If an alarm system is desired to be installed in a completed premise, it is necessary to drill holes, break plaster walls and install a fairly complex network of wiring through the interior walls of the premises. The owner and occupants of the premises are severely inconvenienced and the time and cost for equipment and installation is quite appreciable.

SUMMARY OF THE INVENTION

In view of the foregoing factors and conditions characteristic of the prior art, it is the primary object of the present invention to provide a battery operated transmitter which may be easily and swiftly inserted into a wall adjacent to a door or window.

It is another object of the present invention to provide a battery operated transmitter which transmits a radio frequency signal which is modulated thereby.

It is still another object of the present invention to provide a battery operated transmitter which does not require power from the battery thereof until an alarm condition is present.

It is yet another object of the present invention to provide a battery operated transmitter that incorporates the advantages of the non-battery operated alarm transmitters in that it has a reduced probability of failure along with the advantages of battery operated alarm transmitters in that it can repeatedly transmit alarm conditions.

In accordance with an embodiment of the present invention, the present invention is a container for an alarm transmitter for use in combination with components of a transmitter circuitry which includes voltage control for providing a gated voltage and controlled by a timing circuit. The components also include an audio multivibrator which is electrically coupled to the voltage control in order to receive the gated voltage, a microfork audio filter which is electrically coupled to the audio multivibrator and a modulator which is electrically coupled to the audio multivibrator. The components further include a radio frequency oscillator whose frequency is modulated by the modulator and which has an antenna electrically coupled to its output terminal. The container includes a tubular member which is adapted to be installed into a hole in a wall adjacent to a door or a window and an elongated, rectangular member adapted to be inserted into the tubular member and also adapted to have the components of the transmitter circuitry placed thereon. The container also includes a battery, which has one of its lead electrically coupled to the voltage control and electrical-coupling device for electrically coupling the other lead of the battery to the voltage control in order to complete the circuit. The electrical-coupling device includes a reed relay which is held normally open by a magnet which is placed in the adjacent door or window.

The features of the present invention which are believed to be novel are set forth with particularity in the appended claims.

Other objects and many of the attendant advantages will be more readily appreciated as the same becomes better understood by reference to the following detailed description and considered in connection with the accompanying drawing in which like reference symbols designate like parts throughout the figures.

DESCRIPTION OF THE PREFERRED EMBODIMENT

Figure 1:
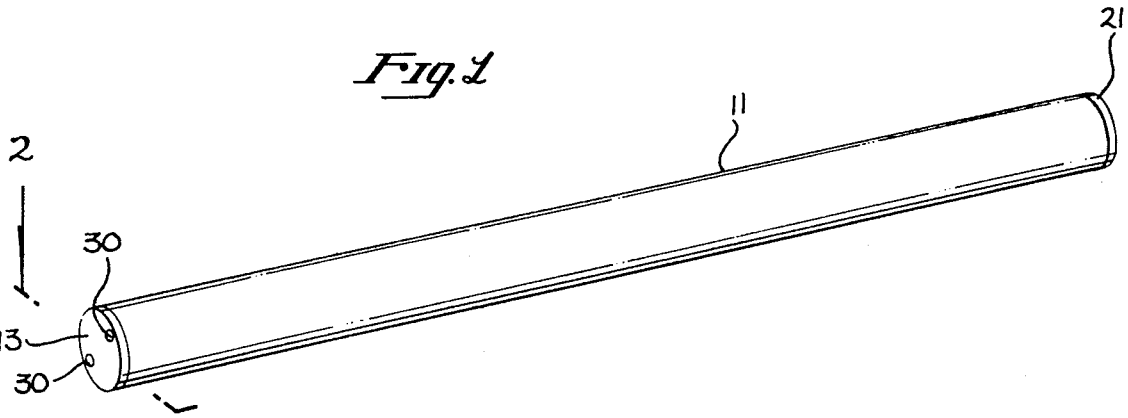
FIG. 1 is a perspective view of a container for an alarm transmitter which is adapted for insertion into a wall in accordance with the principles of the present invention.

In order to best understand the present invention it is necessary to read the foregoing description of its preferred embodiment and to review the accompanying drawing showing the preferred embodiment thereof. Referring to FIG. 1 the present invention is a container 11 for an alarm transmitter for use in combination with components of an alarm transmitter circuitry. The container 11 is a tubular member which is adapted to be inserted into a wall adjacent to either a door or a window. In order to insert the container 11 into the wall a hole must be drilled in the wall of such a size that the container 11 may be slideably engaged therein. The container 11 may also be inserted into the wall adjacent to articles which an individual fears may be removed by a would be thief such as a valuable painting. There is a magnet disposed in the door, window or valuable article which when present maintains the alarm in its armed state and which when removed therefrom triggers the alarm circuitry.

Figure 2:
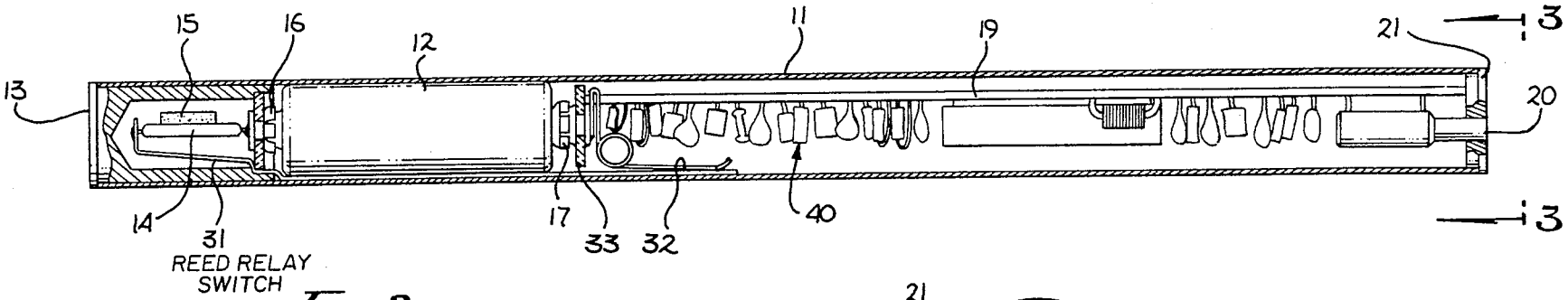
FIG. 2 is a horizontal cross-sectional view of the container of FIG. 1.
Figure 3:
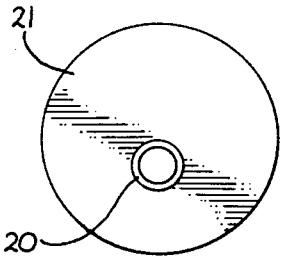
FIG. 3 is a rear end view of the container of FIG. 1.

Referring now to FIG. 2 a battery 12 is disposed within the container 11. The container 11 has a front end cap 13 which has a reed relay switch 14 disposed therein. A small magnet 15 holds the reed relay switch normally closed, but the magnet in the door, window or valuable article maintains the reed relay switch normally open. The reed relay switch 14 is electrically coupled to the battery 12 by a first connector 16 at one terminal of the battery 12. There is a second connector 17 electrically coupled to the other terminal of the battery 12. Inside the container 11 there is disposed an elongated, rectangular member 19 which has been adapted to be inserted into the container 11 and which is also adapted to have the components of the transmitter circuitry placed thereon. An antenna 20 is mechanically coupled to the elongated, rectangular member 19 adjacent to the rear end of the container 11. The container 11 has a rear end cap which has a hole therein aligned with the antenna 20.

Referring now to FIG. 2 in conjunction with FIG. 1 the front end cap 13 has a pair of access holes 30 into which a double prong tool must be inserted in order to remove the front end cap 13 from the container 11. The requirement of the use of the double prong tool makes the container 11 tamper-proof. The front end cap 13 is tapered so that it may be pressed fit into the container 11 thereby also making it difficult to tamper with the container 11. The reed relay switch 14 is mounted onto a connector plate 31 upon which the insulated portion of the battery 12 also rests. Attached to the elongated, rectangular member 19 is a spring contact 32 which is electrically coupled to the connector plate and which is in mechanically contact therewith. The second connector 17 is mechanically coupled to the elongated, rectangular member 19 by a battery support member 33 and is electrically coupled to components 40 of a transmitter alarm circuitry. Although not shown in FIG. 2 the elongated, rectangular member 19 has an end tab which is inserted into the battery support 33.

The inventor wishes to point out that the order of assembling components within the container 11 is important in that the battery 12 may be removed without removing the components 40 of the transmitter alarm circuitry for ease in maintenance and repair. The antenna 20 should be placed adjacent to the rear end cap 21 with its end being flushed therewith. The components 40 of the transmitter alarm circuitry should then be placed adjacent to the antenna 20. The second connector 17 is electrically coupled to the components 40 of the alarm transmitter circuitry. The battery 12 should be placed adjacent to the components 40 of the alarm transmitter circuitry. Finally, the front end cap 13 which includes the reed relay switch 14 should be placed adjacent to the battery 12 enclosing the entire alarm transmitter therein. The battery connectors 16 and 17 are such that the alarm transmitter circuitry is quickly and easily disconnected once the double prong access tool has been used to remove the front end cap 13 from the container 11. The use of the spring contact 32 and connector plate 31 eliminates the use of wires for connecting the reed relay switch to the components 40 of alarm transmitter circuitry.

The spring contact 32 is an economical device for electrically connecting the reed relay switch 14 to the components 40 of the alarm transmitter circuitry. A jack and plug assembly may also be used in another embodiment to electrically couple the reed relay switch 14 to these components 40.

Figure 4:
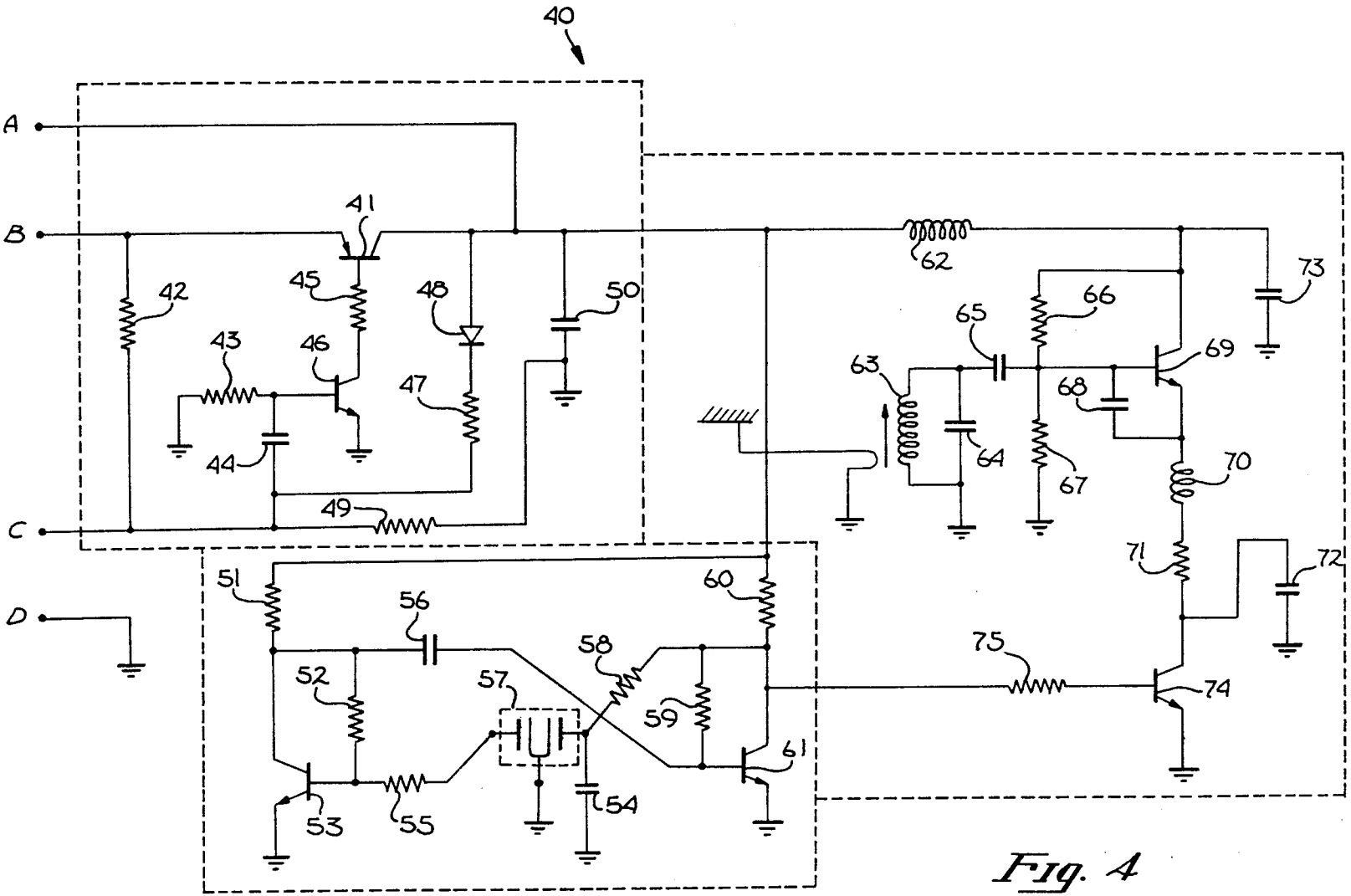
FIG. 4 is a schematic drawing of the transmitter circuitry of the alarm transmitter which is contained in the container of FIG. 1.

Referring now to FIG. 4 the components 40 of the alarm transmitter circuitry include a voltage control for providing a gated voltage control having two power input terminals electrically coupled to the first and second connectors 16 and 17 through the reed-relay switch 14. The voltage control includes a first transistor 41 and a first resistor 42 disposed across the terminals of the battery 12. A second resistor 43 is electrically coupled in series to a first capacitor 44 to ground to one of the terminals of the battery 12. The other terminal of the battery 12 is electrically coupled to the first transistor 41 to a third resistor 45. A second transistor 46 has its emitter electrically coupled to ground, its base electrically coupled to the second resistor 43 and its collector electrically coupled to the third resistor 45. A fourth resistor 47 is electrically coupled in series to a diode 48 to the collector of the first transistor 41 and to one of the terminals of the battery 12. This same terminal is also electrically coupled to the other terminal in series with with a fifth resistor 49 and a second capacitor 50. The voltage control provides a gated voltage output.

The components 40 of the alarm transmitter circuitry also include an audio multivibrator having an input terminal which is electrically coupled to the voltage control in order to receive the gated voltage. The audio multivibrator includes a sixth resistor 51 electrically coupled in series to a seventh resistor 52 and the base of a third transistor 53 having its emitter electrically coupled to ground and its collector electrically coupled to the sixth resistor 51. An eighth resistor 55 is electrically coupled to the base of the third transistor 53. A third capacitor 54 is electrically coupled to ground and a fourth capacitor 56 is electrically coupled to the sixth resistor 51. The audio multivibrator also includes a microfork filter 57 which is a subminiature piezoelectric tuning fork and which is electrically coupled between the eighth resistor 55 and the third capacitor 54 and a ninth resistor 58 which is electrically coupled to a tenth resistor 59 and an eleventh resistor 60 which is electrically coupled to the collector of a fourth transistor 61 which has its base electrically coupled to tenth resistor 59 and its emitter electrically coupled to ground.

The radio frequency oscillator further includes a coil 62 electrically coupled to the eleventh resistor 60. The radio frequency oscillator also includes a variable coil 63 electrically coupled in parallel to a fifth capacitor 64 to ground and in series to a sixth capacitor 65 and a twelfth resistor 66 to the coil 62. The sixth capacitor 65 is also electrically coupled to both a thirteenth resistor 67, a seventh capacitor 68 and the base of a fifth transistor 69 that has its emitter electrically coupled in series to a second coil 70, a fourteenth resistor 71 and an eighth capacitor 72 to ground and its collector both to the first coil 62 and a ninth capacitor 73. A sixth transistor 74 has its emitter electrically coupled to ground, its collector electrically coupled to the fourteenth resistor 71 and its base electrically coupled in series with a fifteenth resistor 75 to the collector of the fourth transistor 61 which provides modulation to the radio frequency generated by frequency oscillator.

The inventor also wishes to point out that the reed relay switch 14 may be encapsulated within the front end cap 13 for added security. Furthermore the shape of the container 11 allows for ease in the installation of the alarm transmitter into an integrated alarm system thereby reducing the installation time thereof by ninety percent.

From the foregoing it can be seen that a container for an alarm transmitter has been described. It should be noted that the schematics of the container and its mechanical components are not drawn to scale and that the values of the electrical components in the circuit diagram are not provided, because they are not considered to be significant to the concepts of the invention.

Accordingly, it is intended that the foregoing disclosure and showing made in the drawing shall be considered only as illustrations of the principles of the present invention.

What is claimed is:

1. A combination of an improved end cap and a container for an alarm transmitter and components of a transmitter circuitry, having two power input terminals, said combination comprising:

a. a tubular member which is to be inserted into a hole in a frame for a door or window;

b. an elongated, rectangular member which is to be inserted into said tubular member and also which has the components of the transmitter circuitry placed thereon;

c. a battery having a first terminal which is electrically coupled to one of the power input terminals of the transmitter circuitry and second terminal;

d. a pair of mated battery connectors which are mechanically coupled to the first and second terminals of said battery;

e. supporting means for supporting said pair of mated battery connectors within said tubular member on said elongated, rectangular member;

f. an improved end cap which is a cylindrical member having an open end with a cavity and a closed, flat end, said cylindrical member having a shoulder of a diameter which is equal to the outer diameter of said tubular member at said closed, flat end to provide a stop for said improved end cap and the rest of said cylindrical member is slightly tapered so that said improved end cap may be press fit into said tubular member; and g. a reed relay switch which is disposed in said cavity of said improved end cap and which is electrically coupled to one of said pair of mated battery connectors.

2. A combination of an improved end cap and a container for an alarm transmitter according to claim 1 wherein said combination also comprises:

a. a magnet which is magnetically and mechanically coupled to said reed relay switch so that said reed relay switch is normally closed absent any external magnet.

3. A combination of an improved end cap and a container for an alarm transmitter according to claim 2 wherein the order of placing the components of the transmitter circuitry is as follows:

a. the components of the transmitter circuitry are placed first in said tubular member:

b. said battery is then placed in said tubular member; and c. said reed relay switch is placed in said tubular member after said battery.

4. A combination of an improved end cap and a container for an alarm transmitter according to claim 1 wherein said improved end cap further comprises:

a. a support member which is electrically conductive and which is electrically coupled to said reed relay switch; and b. electrically connecting means for connecting the components of the transmitter circuitry to said support member.

5. A combination of an improved end cap and a container for an alarm transmitter according to claim 4 wherein said electrical-connecting means is a spring contact.

6. A combination of an improved end cap and a container for an alarm transmitter according to claim 4 wherein said electrical-connecting means is a plug and jack assembly.

7. A combination of an improved end cap and a container for an alarm transmitter according to claim 6 wherein said improved end cap has a pair of access holes making contact said tubular member accessible only by a double prong tool and thereby making said improved end cap tamper-proof.

* * * * *